US009810174B2

(12) United States Patent
Wahl et al.

(10) Patent No.: US 9,810,174 B2
(45) Date of Patent: Nov. 7, 2017

(54) CONSTRUCTIONS FOR PISTON THERMAL MANAGEMENT

(71) Applicant: Achates Power, Inc., San Diego, CA (US)

(72) Inventors: Michael H. Wahl, Bonita, CA (US); Ryan G. MacKenzie, San Diego, CA (US); James U. Lemke, La Jolla, CA (US)

(73) Assignee: ACHATES POWER, INC., San Diego, CA (US)

( * ) Notice: Subject to any disclaimer, the term of this patent is extended or adjusted under 35 U.S.C. 154(b) by 837 days.

(21) Appl. No.: 13/655,377

(22) Filed: Oct. 18, 2012

(65) Prior Publication Data

US 2013/0112175 A1 May 9, 2013

Related U.S. Application Data

(60) Provisional application No. 61/628,736, filed on Nov. 4, 2011.

(51) Int. Cl.

| | |
|---|---|
| ***F01B 7/12*** | (2006.01) |
| ***F02F 3/16*** | (2006.01) |
| ***F02F 3/22*** | (2006.01) |
| ***F02B 25/08*** | (2006.01) |
| *F02B 75/28* | (2006.01) |
| *F02B 75/02* | (2006.01) |
| *F01B 7/14* | (2006.01) |
| *F01M 1/06* | (2006.01) |

(52) U.S. Cl.

CPC ..... *F02F 3/16* (2013.01); *F02B 25/08* (2013.01); *F02B 75/282* (2013.01); *F02F 3/22* (2013.01); *F01B 7/14* (2013.01); *F01M 2001/066* (2013.01); *F02B 75/28* (2013.01); *F02B 2075/025* (2013.01); *F02B 2075/027* (2013.01)

(58) Field of Classification Search

CPC .. F02B 75/28; F02B 2075/027; F02B 75/282; F02B 2075/025; F01B 7/14

USPC ..... 123/51 R

See application file for complete search history.

(56) References Cited

U.S. PATENT DOCUMENTS

| | | | | |
|---|---|---|---|---|
| 2,159,402 A | | 5/1939 | Retschy | 123/193 |
| 3,149,409 A | * | 9/1964 | Maruhn | 29/888.045 |
| 4,253,430 A | | 3/1981 | Garter et al. | 123/41.38 |
| 4,419,969 A | * | 12/1983 | Bundrick, Jr. | 123/48 R |
| 4,679,493 A | * | 7/1987 | Munro et al. | 92/212 |
| 4,712,600 A | | 12/1987 | Hamajim et al. | 164/97 |
| 4,848,291 A | | 7/1989 | Kawamura | 123/193 |
| 5,282,411 A | * | 2/1994 | Hirai et al. | 92/176 |

(Continued)

FOREIGN PATENT DOCUMENTS

KR 2005068448 A * 7/2005

OTHER PUBLICATIONS

*The Brazing Guide*, http://www.gh-ia.com/pdf/GHIA-Brazing-Guide.pdf.

(Continued)

*Primary Examiner* — Jacob Amick
*Assistant Examiner* — Charles Brauch
(74) *Attorney, Agent, or Firm* — Terrance A. Meador

(57) ABSTRACT

A piston construction with an end surface is equipped with a pattern of insulating cavities embedded in an upper end of the piston, between the end surface and interior portions of the piston that are cooled by circulating liquid coolant.

9 Claims, 9 Drawing Sheets

(56) References Cited

U.S. PATENT DOCUMENTS

| | | | | |
|---|---|---|---|---|
| 5,477,820 | A | 12/1995 | Rao | 123/193.6 |
| 7,469,664 | B2 * | 12/2008 | Hofbauer et al. | 123/54.1 |
| 7,654,240 | B2 | 2/2010 | Jarrett et al. | 123/193.6 |
| 9,163,505 | B2 | 10/2015 | Dion et al. | F01B 7/08 |
| 2009/0293820 | A1 * | 12/2009 | Lemke et al. | 123/41.35 |
| 2010/0107868 | A1 | 5/2010 | Scharp et al. | 92/159 |
| 2011/0271932 | A1 | 11/2011 | Fuqua et al. | 123/301 |
| 2012/0073526 | A1 | 3/2012 | Dion et al. | 123/41.44 |
| 2013/0052321 | A1 * | 2/2013 | Liu | 426/433 |
| 2015/0252715 | A1 | 9/2015 | MacKenzie | F01P 3/08 |

OTHER PUBLICATIONS

Definition of "openwork", http://dictionary.reference.com/browse/openwork.

*DI Combustion Chamber Design*, Vegburner Website, downloaded Aug. 4, 2017, from http://vegburner.co.uk/DIcombustion.html.

* cited by examiner

CONSTRUCTIONS FOR PISTON THERMAL MANAGEMENT

PRIORITY

This application claims the benefit of U.S. provisional application for patent No. 61/628,736, filed Nov. 4, 2011, for "Constructions for Piston Thermal Management".

BACKGROUND

The field is internal combustion engines, and is particularly related to constructions for thermal management of pistons. In some aspects, the field includes internal combustion engines in which the end surface of a piston crown is insulated from the interior of the piston by cavities embedded in the crown.

With reference to FIG. 1, an internal combustion engine is illustrated by way of an opposed-piston engine that includes at least one cylinder 10 with a bore 12 and longitudinally-displaced exhaust and intake ports 14 and 16 machined or formed therein. Fuel injector nozzles 17 are located in or adjacent injector ports that open through the side of the cylinder, at or near the longitudinal center of the cylinder. Two pistons 20, 22 are disposed in the bore 12 with their end surfaces 20*e*, 22*e* in opposition to each other.

Operation of an opposed-piston engine with one or more cylinders such as the cylinder 10 is well understood. In this regard, and with reference to FIG. 2, in response to combustion occurring between the end surfaces 20*e*, 22*e* the opposed pistons move away from respective top dead center (TDC) positions where they are at their closest positions relative to one another in the cylinder. While moving from TDC, the pistons keep their associated ports closed until they approach respective bottom dead center (BDC) positions in which they are furthest apart from each other. The pistons may move in phase so that the exhaust and intake ports 14, 16 open and close in unison. Alternatively, one piston may lead the other in phase, in which case the intake and exhaust ports have different opening and closing times.

As the pistons continue moving away from each other, the intake port 16 opens while the exhaust port 14 is open and a charge of pressurized air ("charge air") is forced into the cylinder 10, driving exhaust gasses out of the exhaust port 14. The displacement of exhaust gas from the cylinder through the exhaust port while admitting charge air through the intake port is referred to as "scavenging". Because the charge air entering the cylinder flows in the same direction as the outflow of exhaust gas (toward the exhaust port), the scavenging process is referred to as "uniflow scavenging".

As the pistons move through their BDC locations and reverse direction, the intake and exhaust ports are closed by the pistons, scavenging ceases, and the charge air in the cylinder is compressed between the end surfaces 20*e* and 22*e*. Typically, the charge air is swirled as it passes through the intake port 16 to promote scavenging while the ports are open and, after the ports close, to mix the air with the injected fuel. Typically, the fuel is diesel which is injected into the cylinder by high pressure injectors. With reference to FIG. 1 as an example, the swirling air (or simply, "swirl") 30 has a generally helical motion that forms a vortex in the bore which circulates around the longitudinal axis of the cylinder. As best seen in FIG. 2, as the pistons advance toward their respective TDC locations in the cylinder bore, fuel 40 is injected through the nozzles 17 directly into the swirling charge air 30 in the bore 12, between the end surfaces 20*e*, 22*e* of the pistons. The swirling mixture of charge air and fuel is compressed in a combustion chamber 32 defined between the end surfaces 20*e* and 22*e* when the pistons 20 and 22 are near their respective TDC locations. When the mixture reaches an ignition temperature, the fuel ignites in the combustion chamber, driving the pistons apart toward their respective BDC locations In some aspects of internal combustion engine construction it is desirable to utilize pistons with highly contoured end surfaces that interact with swirl and with squish flow from the periphery of the combustion chamber to produce complex, turbulent charge air motion that encourages uniform mixing of air and fuel. However, combustion imposes a heavy thermal load on these pistons. The highly contoured end surfaces create non-uniform thermal profiles that are not suitably cooled by conventional forced cooling configurations, leading to asymmetrical thermal stress, wear, and piston fracture.

Constructions for cooling a piston with a highly contoured end surface can include one or more internal galleries that conduct liquid coolant along the rear surface of a piston crown. Desirably, these constructions tailor internal cooling of the piston so as to deliver a relatively high cooling capacity to the hottest portions of the crown as compared with the cooler parts. For example, one such construction combines impingement cooling of the hottest portions of the interior with shaped gallery spaces that conduct flows of coolant to other internal portions of the piston. However, there is a price to be paid. In this regard, cooling the piston interior increases the flow of heat from the piston end surface to the piston interior, thereby reducing the amount of heat that is available to convert into useful work. Accordingly, while it is desirable to cool the interior of the piston in the vicinity of the piston end surface, it is also desirable to limit the amount of heat transferred from the end surface into the piston's interior. The trade-offs in piston construction with respect to cooling the interior of the piston while reducing loss of heat through the end surface form the basis of piston thermal management.

SUMMARY

An object of this disclosure is to provide a construction for piston thermal management that affords effective cooling of the body of a piston while reducing the flow of heat from the end surface through the body. In some aspects the end surface is a highly contoured end surface.

Another object is to provide piston crown constructions that increase the thermal resistance between the end surface of a piston crown and interior portions of the crown that are cooled by circulating liquid coolant.

Still another object is to provide a piston construction with insulating and cooling structures that can be tailored for thermal management of highly contoured features of the end surface.

DETAILED DESCRIPTION OF THE PREFERRED EMBODIMENTS

The following description includes a ported, uniflow scavenging engine having at least one cylinder in which a pair of pistons is disposed with their end surfaces in opposition. This explanatory context is intended only to provide a basis for understanding various piston construction embodiments by way of illustrative examples in an operational internal combustion environment; it is not intended to limit the application of the illustrated constructions to any particular engine architecture.

Figure 1:
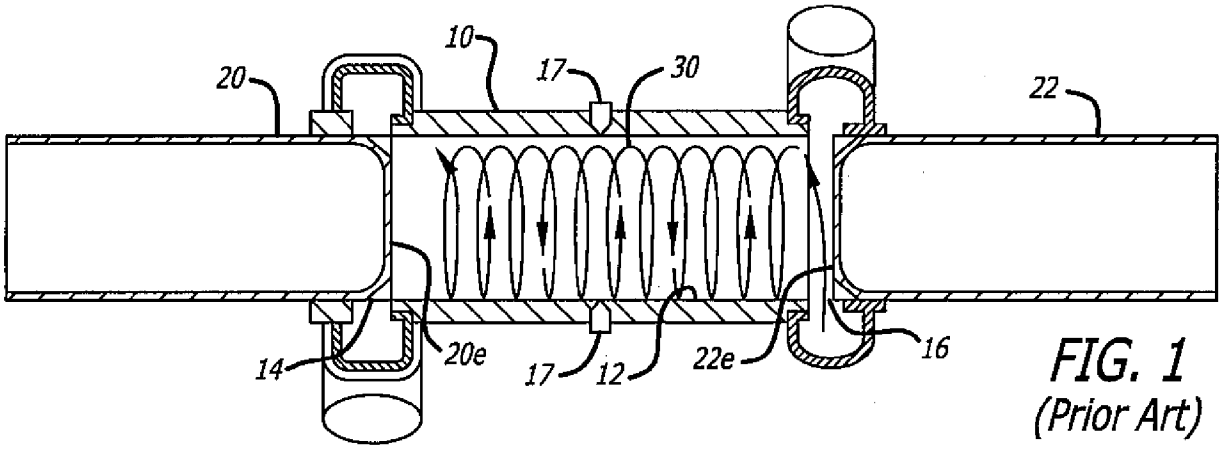
FIG. 1 (Prior Art)
FIG. 1 is a side sectional partially schematic drawing of a cylinder of a prior art opposed-piston engine with opposed pistons near respective bottom dead center locations, and is appropriately labeled "Prior Art".
Figure 2:
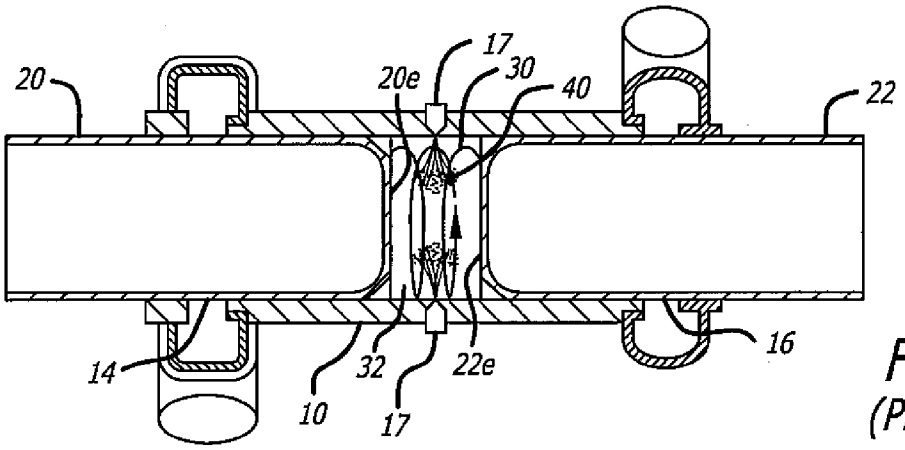
FIG. 2 (Prior Art)
FIG. 2 is a side sectional partially schematic drawing of the cylinder of FIG. 1 with the opposed pistons near respective top dead center locations where end surfaces of the pistons define a combustion chamber, and is appropriately labeled "Prior Art".
Figure 3:
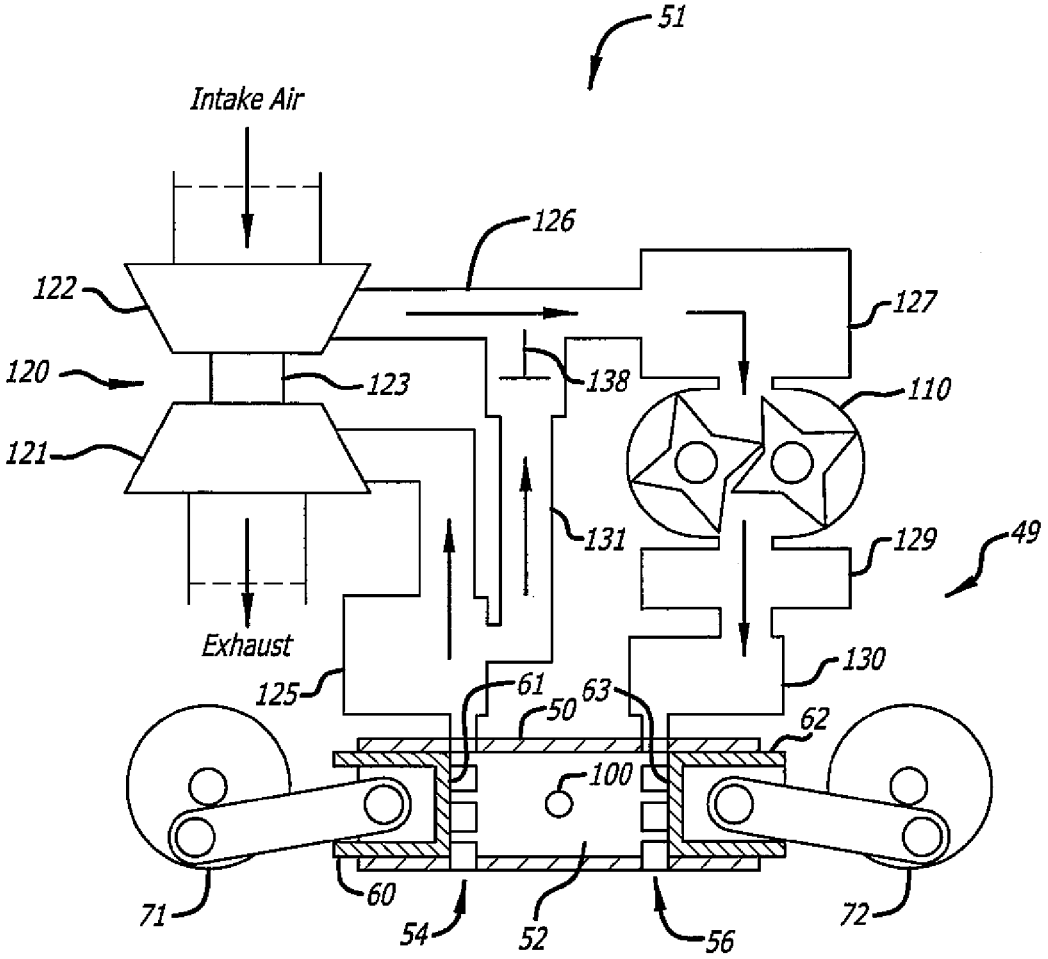
FIG. 3 is a conceptual schematic diagram of an internal combustion engine in which aspects of the invention are illustrated.

In FIG. 3, an internal combustion engine 49 that is embodied by an opposed-piston engine has at least one ported cylinder 50. For example, the engine may have one ported cylinder, two ported cylinders, three ported cylinders, or four or more ported cylinders. For purposes of illustration, in the examples to be illustrated and described the engine is an engine of the opposed-piston type that is presumed to have a plurality of ported cylinders. In this regard, each cylinder 50 has a bore 52 and exhaust and intake ports 54 and 56 formed in respective ends thereof. The exhaust and intake ports 54 and 56 each include one or more circumferential arrays of openings in which adjacent openings are separated by a solid bridge. (In some descriptions, each opening is referred to as a "port"; however, the construction of a circumferential array of such "ports" is no different than the port constructions shown in FIG. 3.) Exhaust and intake pistons 60 and 62 are slidably disposed in the bore 52 with their end surfaces 61 and 63 opposing one another. The exhaust pistons 60 are coupled to a crankshaft 71, and the intake pistons are coupled to the crankshaft 72. When the pistons 60 and 62 of a cylinder 50 are at or near their TDC positions, a combustion chamber is defined in the bore 52 between the end surfaces 61 and 63 of the pistons. Fuel is injected directly into the combustion chamber through at least one fuel injector nozzle 100 positioned in an opening through the sidewall of the cylinder 50.

With further reference to FIG. 3, the engine 49 includes an air management system 51 that includes a supercharger 110 and a turbo-charger 120 with a turbine 121 and a compressor 122 rotating on a common shaft 123. The turbine 121 is coupled to the exhaust subsystem and the compressor 122 is coupled to the charge air subsystem. The turbine 121 is rotated by exhaust gas passing through it. This rotates the compressor 122, causing it to generate charge air by compressing intake air. The charge air output by the compressor 122 flows through a conduit 126 to a charge air cooler 127, whence it is pumped by the supercharger 110 to the intake ports. Air compressed by the supercharger 110 is output through a charge air cooler 129 to an intake manifold 130. The intake ports 56 receive charge air pumped by the supercharger 110, through the intake manifold 130.

An internal combustion engine 49 of the opposed-piston type includes at least one cylinder 50 with longitudinally-separated exhaust and intake ports 54 and 56 as per FIG. 3. The pistons 60 and 62 are disposed in opposition in the cylinder bore 52. As the pistons reciprocate in the bore during engine operation, contoured piston end surfaces, each including a bowl adjoined with a protruding side, cooperate to define a combustion chamber with a semi-ellipsoidal space that tapers toward each end so as to produce complex, turbulent charge air motion including at least swirl and tumble components. See, in this regard, U.S. patent application Ser. No. 13/066,589, filed Apr. 18, 2011. The complex air motion in the combustion chamber encourages the mixing of charge air with fuel for more complete and more uniform ignition than would otherwise occur.

Figure 4:
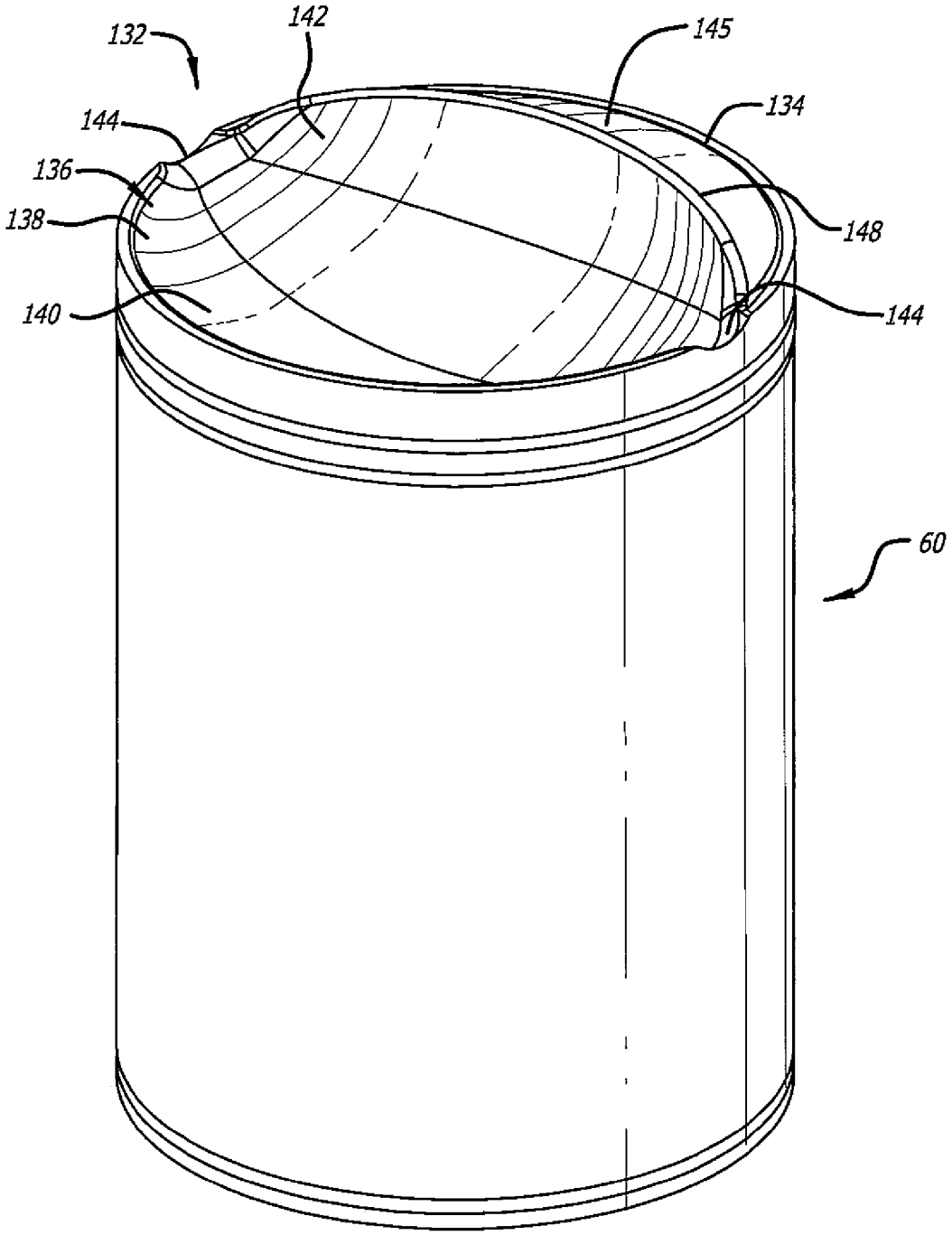
FIG. 4 is an elevational perspective view of a piston of a pair of pistons in which identical end surfaces of the pair of pistons are formed to define a combustion chamber construction.

One example of a piston with a contoured end surface is illustrated in FIG. 4. The structures of the piston end surfaces of two opposed pistons that define a combustion chamber are essentially identical to each other; accordingly, the piston 60 shown in FIG. 4 represents both pistons 60 and 62. The piston 60 has an end surface 132. A flat circumferential area 134 centered on the longitudinal axis of the piston 60 defines a periphery of the end surface 132. A bowl 136 is formed within the periphery. The bowl 136 has a concave surface 138 with a first portion 140 curving inwardly from a plane containing the flat circumferential area 134, toward the interior of the piston 60, and a second portion 142 curving outwardly from the interior of the piston through the plane. The end surface 132 further includes a convex surface 145 within the periphery that curves outwardly from the plane. The convex surface 145 meets the second portion 142 of the concave surface 138 to form a ridge 148 that protrudes outwardly from the end surface 132. At least one notch 144 extends through the periphery into the bowl 136; preferably two aligned notches 144 are provided.

Figure 5:
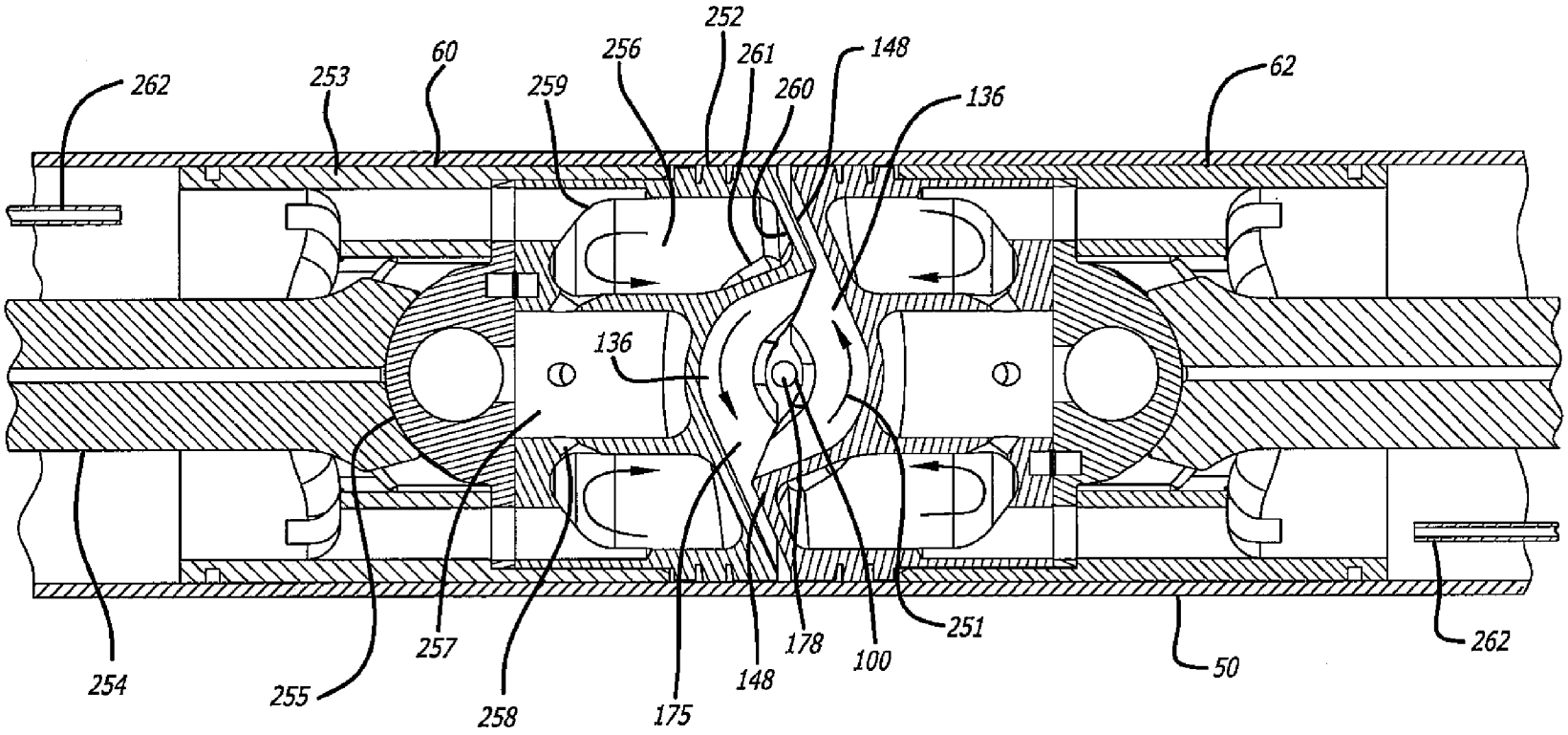
FIG. 5 is a side sectional view of two opposing pistons near TDC positions in a cylinder showing construction features of the pistons and a combustion chamber defined between the end surfaces of the pistons.

With reference to FIGS. 4 and 5, as the pistons 60 and 62 approach TDC the charge air in the cylinder is increasingly compressed between the end surfaces 61 and 63. As the pistons 60 and 62 move through their respective TDC locations, the opposing concave and convex surfaces define a combustion chamber 175 having a shape that tapers to two diametrically aligned ends. For example, the combustion chamber has a semi-ellipsoidal shape. Preferably, each of the opposed injector ports 100 is located at or near a respective tapered end of the combustion chamber 175. Opposing pairs of notches 144 in the end surfaces 132 define injection ports that open into the combustion chamber 175 at opposing pole positions of the semi-ellipsoidal shape. Preferably the injector ports are aligned with a major axis 178 of the combustion chamber 175.

As the pistons 60 and 61 move toward TDC, swirling charge air is increasingly compressed between the end surfaces 132. As the pistons approach TDC, compressed air flows from the peripheries 134 of the end surfaces through squish channels defined between the concave-convex surface pairs 140, 145. These squish airflows flow into the combustion chamber. These squish flows are oppositely-directed, parallel, and skewed with respect to the major axis 178. This spatial relationship causes generation of a tumbling motion 251 when the squish flows encounter the outwardly-directed end surface portions 142 of the end surfaces. When fuel is injected into the turbulent charge air, combustion occurs.

Figure 6:
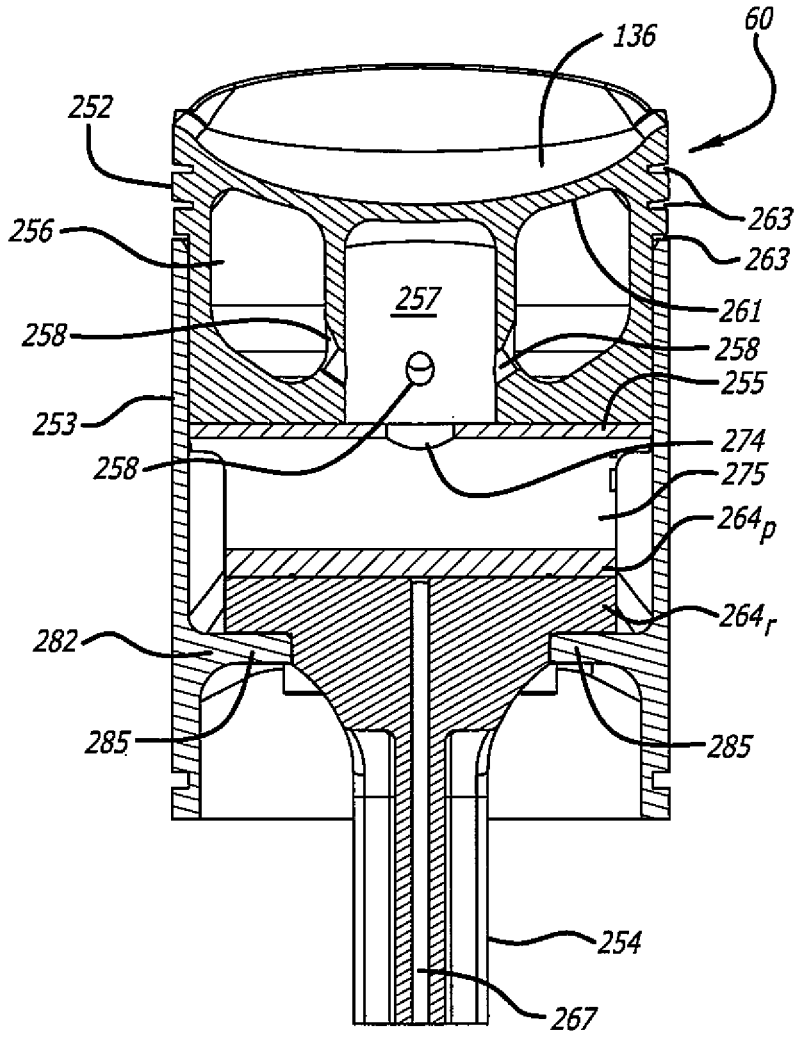
FIG. 6 is a side sectional view of one of the pistons of FIG. 5 rotated 90° from the view of FIG. 5.

An internal piston cooling construction is identical for the pistons in the engine is best seen in FIGS. 5 and 6, where the piston 60 includes a crown 252 assembled or joined to a skirt 253. A piston rod 254 is coupled to the piston 60 by a coupling mechanism 255. The contoured end surface 132 of the piston 60 is formed on the face of the crown 252. The crown 252 is cooled by flow of a liquid coolant through one or more internal galleries in the body of the crown. For example, the crown 252 has an annular gallery 256 that follows the periphery of the crown and girds a central gallery 257. The annular gallery 256 communicates with the central gallery 257 through holes 258. The annular gallery 256 has an asymmetric profile that rises as at 260 under the ridge 148 and that slants upwardly as at 261 under the concave portion 138 of the bowl 136. The central gallery 257 abuts the deepest part of the bowl 136. Liquid coolant, preferably, but not necessarily, lubricating oil, is provided in a high pressure stream from a jet 262. The stream enters through an opening 259 in the floor of the annular gallery 256. The liquid coolant strikes the interior surface of the annular gallery at its highest point 260, thereby cooling that portion of the crown by impingement, and flows from there throughout the annular gallery 256. The liquid coolant delivered by the high velocity stream collects or accumulates in the central gallery 257 where it continuously irrigates the interior portion of the crown along the inside of the ridge 148. Liquid coolant flowing throughout the annular gallery 256 washes and cools an annular portion of the crown around and under the bowl 136, and washes and cools an annular portion of the crown sidewall that includes ring grooves 263. Reciprocation of the piston agitates the liquid coolant, which causes it to circulate in the annular gallery 256. In response to the agitation and piston motion, liquid coolant also flows from the annular gallery 256 into the central gallery 257 through the holes 258. Piston reciprocation also agitates the liquid coolant collected or accumulated in the central gallery 257 so as to cool the crown 252 beneath the central portion of the bowl 136. The liquid coolant flows from the bottom of central gallery 257 through a hole in the coupling mechanism 255, and out the sides of the coupling mechanism 255 into the interior of the skirt 253. From there, the liquid coolant flows out the open end of the skirt 253 whence it is collected in a sump.

Thermal Management Construction:

A thermal management construction for use in an internal combustion engine will be described with reference to the piston 300 of FIG. 7. Although the piston 300 has a unitary structure in which the crown and skirt are a single piece, this is merely for explanation; in fact the thermal management construction to be described can be applied to many different piston assemblies, including those in which a crown is assembled to a piston skirt.

An upper end portion 312 of the piston corresponds to the crown 252 of the piston 60 of FIGS. 4 and 5; for this reason the upper end portion will be referred to as the "crown" 312 of the piston 300. The crown 312 includes an end surface 332 and cooling galleries 356 and 357. The end surface 332 corresponds in contour and function to the piston end surface 132 of FIGS. 4 and 5. In this regard, it includes a periphery 334 and a bowl 336 formed within the periphery. The bowl 336 has a concave surface 338 with a first portion 340 curving inwardly from a plane containing the flat circumferential area 334, toward the interior of the piston 300, and a second portion 342 curving outwardly from the interior of the piston through the plane. The end surface 332 further includes a convex surface 345 within the periphery that curves outwardly from the plane. The convex surface 345 meets the second portion 342 of the concave surface 338 to form a ridge 348 that protrudes outwardly from the end surface 332. At least one notch 344 extends through the periphery into the bowl 336; preferably two aligned notches 344 are provided.

The cooling gallery 356 is an annular gallery that follows the periphery 334 and girds the central gallery 357 and communicates with the central gallery 357. The annular gallery 356 has an asymmetric profile that rises as at 360 under the ridge 348. The central gallery 357 abuts the deepest part of the bowl 336. Liquid coolant is supplied to and circulates through the galleries as described above with reference to the pistons of FIGS. 4-6.

Figure 7:
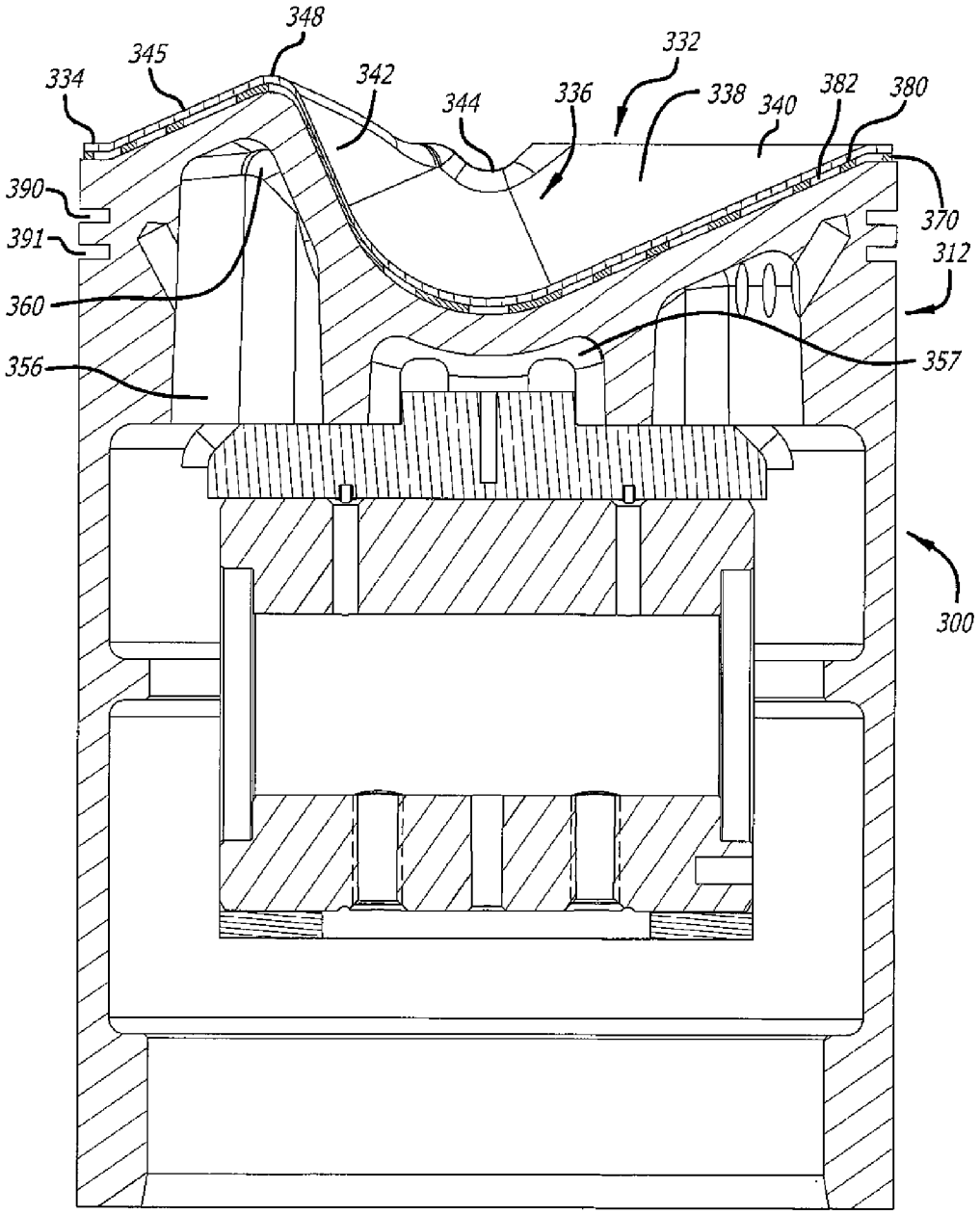
FIG. 7 is a side sectional view of a piston with an end surface configured as shown in FIGS. 4 and 5 and an insulating member including a pattern of insulating air cavities embedded in the piston, between the end surface and an internal piston cooling structure.
Figure 8:
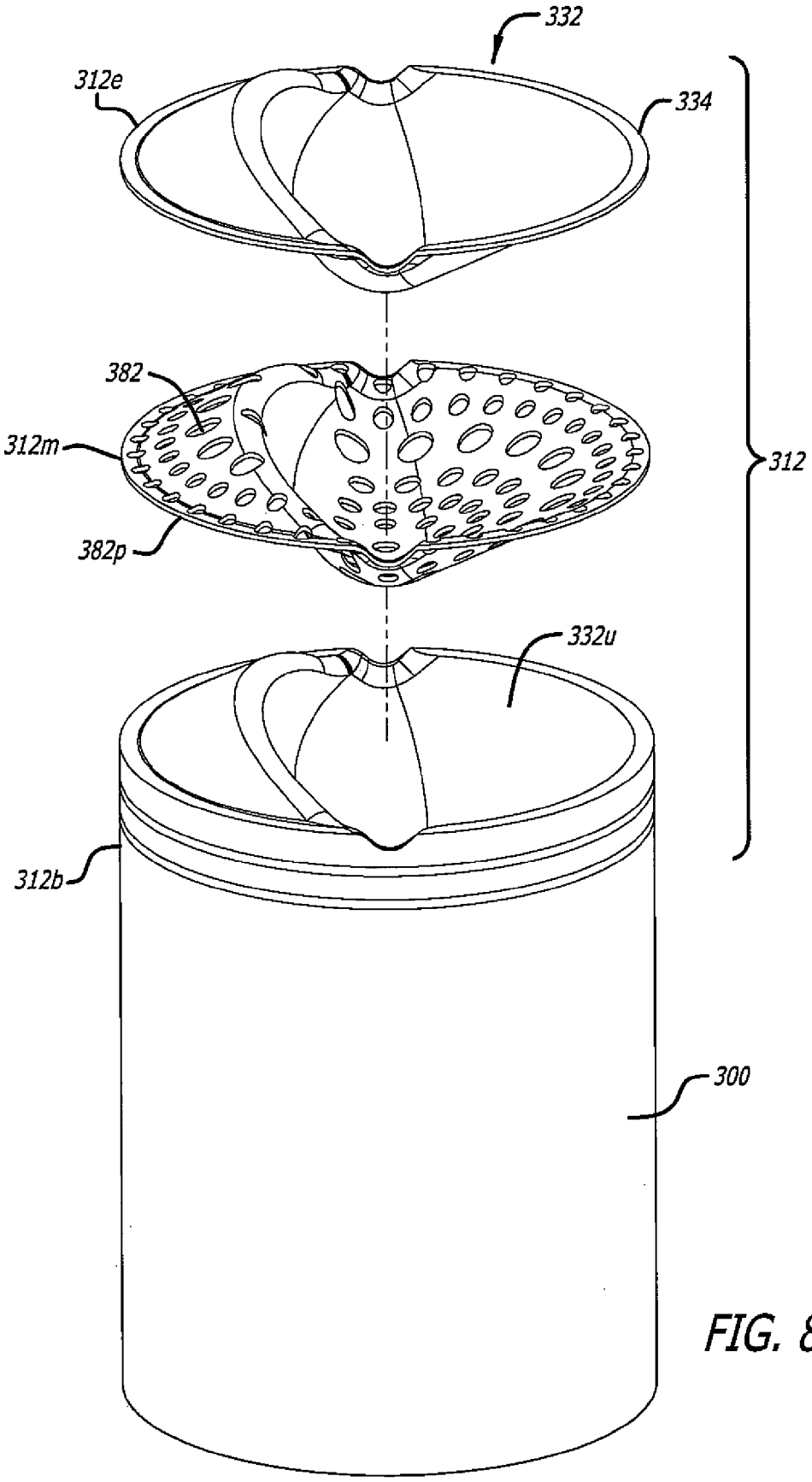
FIG. 8 is an exploded view showing a piston construction in which the insulating air cavities are embedded.

With reference to FIGS. 7 and 8, an insulating structure 370 is disposed in the crown 312 of the piston 300 between the end surface 332 and the galleries 356 and 357. The insulating structure 370 is constituted of openwork 380 with a pattern of holes 382 defining cavities embedded in the crown 312, between the end surface 332 and the cooling galleries 356 and 357. In this regard, openwork is a work of metal or equivalent material having a pattern of openings or holes. The ratio of space to metal is varied by varying the size and density of holes 382.

The cavities contain material having a substantially lower thermal conductivity than the crown material so as to thermally insulate the end surface 332 from the interior of the piston, thereby increasing the retention of the heat of combustion in the combustion chamber. The material can include a gas, a solid, or a semi-solid. For example, the material can include air, metal, glass, ceramic, or sodium or another salt. The form of the material can be gaseous, fibrous, particulate, or solid; it can be uniform, pure, or mixed or blended with other materials.

FIG. 8 illustrates one embodiment of a thermal management construction in which the crown 312 is constituted of an end piece 312*e*, a body piece 312*b*, and a mid piece 312*m*. One side of the end piece 312*e* constitutes the end surface 332. The cooling galleries 356 and 357 (not seen in FIG. 8) are internal to the body piece 312*b*. The upper end surface 332*u* of the body piece 312*b* and the mid piece 312*m* both have the shape of the end surface 332 in order that the crown 312 can be assembled by fitting and attaching the end piece 312*e* to the body piece 312*b*, with the mid piece 312*m* therebetween. Openwork 380 constituted of a pattern of holes 382 is formed in the mid piece 3132*m*. Cavities embedded in the crown 312 are defined by the holes 382 when the mid piece is fixed between the bottom surface of the end piece 312*e* and upper end surface 332*u* of the body piece 312*b*. The holes 382 can be disposed in one or multiple regular or irregular patterns. Within any pattern the size and/or spacing of holes can be varied to locally tailor the degree of thermal insulation. For example, in FIG. 8, the pattern of holes 382 includes an annular array of holes 382*p* in the vicinity of the periphery 334 of the end surface 332.

With the constructions illustrated in FIGS. 7 and 8, a thermal path exists through the end piece 312*e*, the mid piece 312*m*, and the body piece 312*b*. Since the interior of the crown 312 of the piston is cooled by circulation of coolant through the galleries 356 and 357, the flow of heat is from the end surface 332 to the galleries 356 and 357. However, the thermal conductance of the path is reduced by the presence of the embedded cavities.

Thermal Management Design Considerations:

Design of a piston thermal management construction according to FIG. 7 takes at least three temperature constraints into consideration. First, during typical engine operation, oil accumulates in the piston ring grooves 390 and 391. The temperature of the ring groove surfaces should not exceed a temperature at which lubricating oil cokes to avoid coking of the oil which could lead to ring jacking and subsequent ring and/or liner scuffing. A representative limit in this regard is 270° C. Second, presuming the use of the same lubricating oil as the liquid coolant in the cooling galleries, the cooling gallery surface temperatures should not exceed the same limit as that for the ring grooves (270° C., for example) to avoid coking of the oil which could lead to the formation of an insulating layer in the galleries that diminishes cooling and thereby raises the overall piston temperature. Finally, the end surface 132 of the piston crown has a material dependent temperature limit to avoid oxidation and subsequent erosion.

The present thermal management construction affords the opportunity to locally customize the thickness, size and density of the openwork holes according to the localized temperature requirements, and to combine this construction with gallery cooling for maximum effectiveness. Desirably, the present thermal management construction applies to light weight aluminum composite pistons as well as to any piston material combination, e.g., pistons made entirely of steel.

Figure 9:
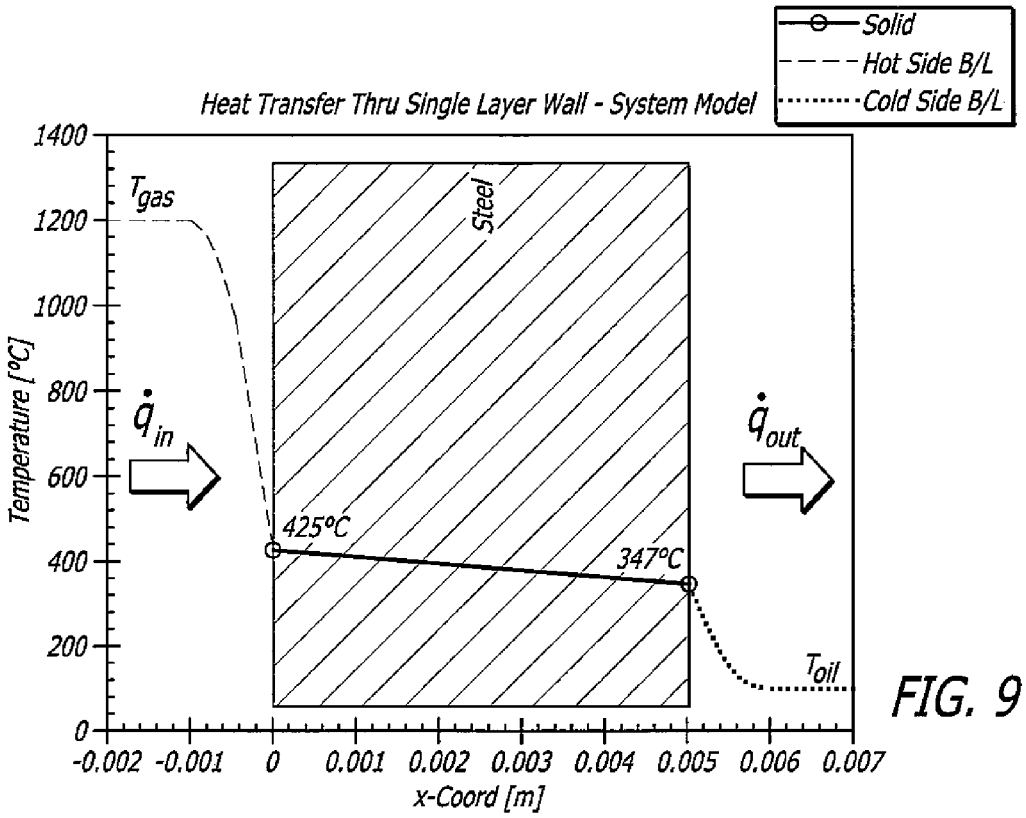
FIG. 9 is a graph showing heat transfer through a single layer wall.

Presume a baseline of a 5 mm thick piston wall with no insulation as shown in FIG. 9 with an end surface ("hot-side") boundary on the left and a cooling gallery surface ("cold-side") boundary on the right. The cycle-averaged gas temperature $T_{gas}$, the oil temperature $T_{oil}$ and their associated heat transfer coefficients have been chosen such that the total heat entering a piston with 80 mm diameter amounts to approximately 3 kW. Given these boundary conditions, the temperature distribution in the wall was calculated. (The temperature of the boundary layer was estimated for illustration purposes only). As indicated on the right hand side of the graph, the hot-side wall temperature of 347° C. is significantly higher than the 270° C. temperature limit for oil coking. Either the cooling has to be improved or the heat input reduced in order to have a workable solution. The present thermal management construction of this disclosure follows the path of reducing the heat input by varying the overall conductivity by means of a multi-layer construction. The guiding principle of this approach is to use a material (e.g. stainless steel) for the hot side that has a sufficiently high oxidation temperature.

Figure 10:
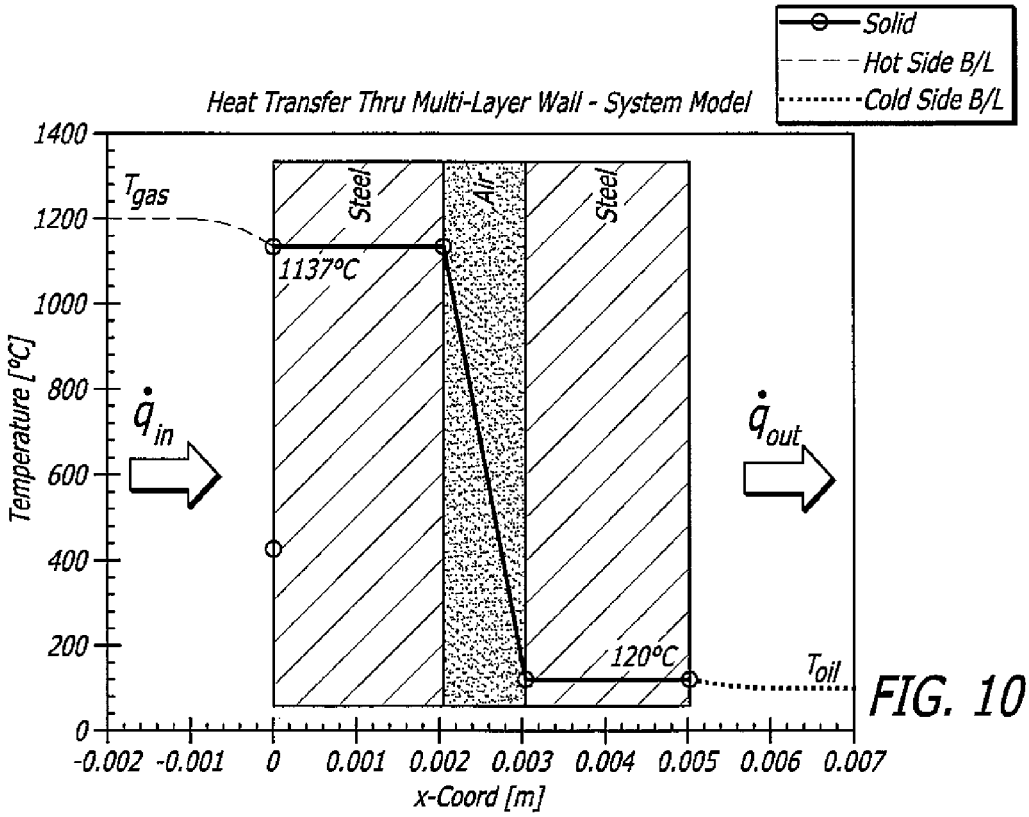
FIG. 10 is a graph showing heat transfer through a first multi-layer wall.

Presume now that an insulating layer constituted of a one extensive cavity filled with air is disposed in the crown of a piston between an end surface layer of steel and an internal layer also of steel. Air layers make for very good insulators due to their low conductivity, and for this reason, provide an effective mechanism for reducing heat transfer. However as seen in FIG. 10, it can be the case that an excessive amount of air space can insulate so well that the hot-side temperature becomes excessive for all but the most exotic materials. Of course, such a result can be undesirable and can be avoided.

One way of reducing the hot-side temperature is to fill the cavity with a material that is more conductive than air but significantly less conductive than metal. For example, replacing the air with a material whose coefficient of thermal conductivity is between that of steel and air (e.g. glass) would make the hot-side temperature more manageable while still substantially reducing the total heat entering the piston.

According to this disclosure, the insulating properties of the single large air gap illustrated in FIG. 10 under the end surface are modulated by "bridging" the air gap at discrete locations with a metallic material which is provided by metal openwork in the vicinity of the end surface as per the construction of FIG. 7. The cavities thereby formed contain a material that is significantly less conductive than the metal of which the piston crown is made. In this example the cavities embedded in the crown 312 of the piston 300 according to FIG. 7 are filled with air. With this construction, the amount of heat conducted across a pattern of air cavities can be controlled via the cross-sectional area, depth, and number of the metallic "bridges" that separate the holes in the openwork. These bridges can be constructed by machining away material on e.g. the upper surface 132*u* seen in FIG. 8, leaving behind prismatic entities of the same height. The end and base pieces 312*e* and 312*b* are subsequently joined in order to bring the metallic "bridges" into contact with the lower surface of the end piece 312*e*.

The same result can also be achieved as illustrated in FIG. 8 by perforating and shaping a sheet metal layer through drillings, stampings, cutting, coining, etc to form the mid piece 312*m*. In this approach, the body piece 312*b*, the mid piece 312*m*, and the end piece 312*e* have to be joined in mutual contact to ensure conduction of heat across the layers.

A third approach would be to build up the material supporting a pattern of holes by methods such as plating or plasma vapor deposition on the lower surface of the end piece 312*e*, on the upper surface 332*u* of the body piece 312*b*, or both.

Figure 11:
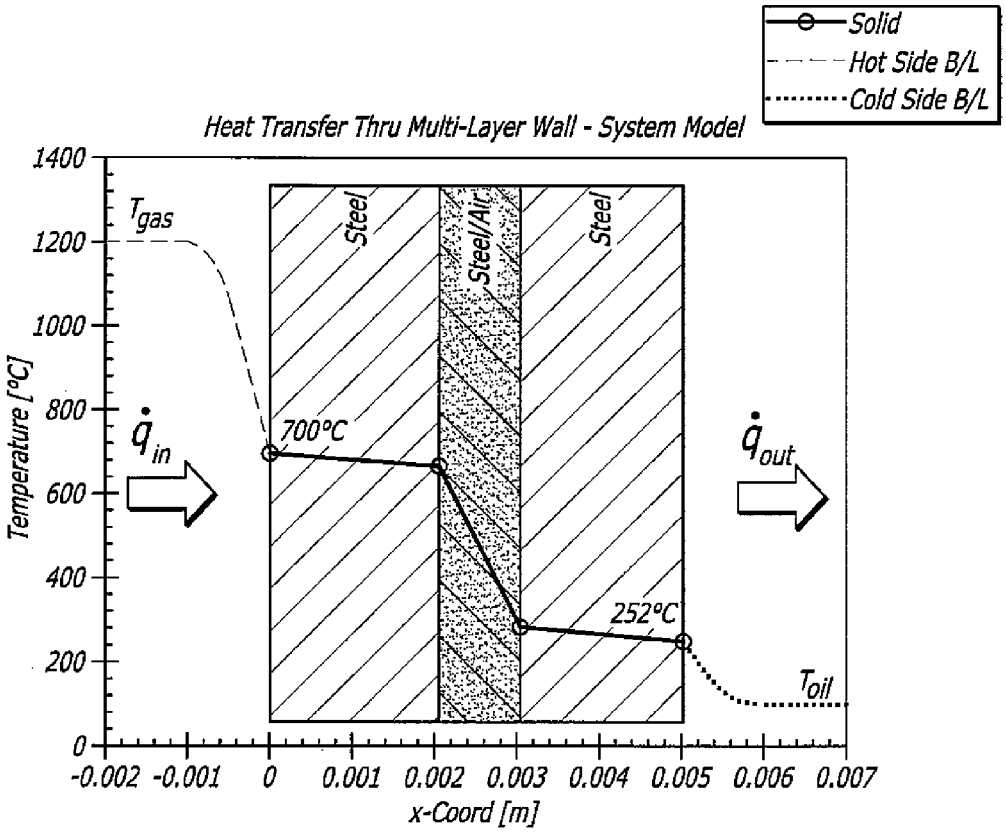
FIG. 11 is a graph showing heat transfer through a second multi-layer wall.

FIG. 11 shows the desired effect of customizing the conductivity of the air gap to such a degree that the cold-side temperature stays below 270° C. while keeping the hot-side temperature within the range of commonly available and therefore cost effective materials (e.g. stainless steel).

A summary of the thermal conductivity coefficients used in the comparison illustrated in FIG. 11 is provided in Table 1.

| Material | Λ [W/(K · m)] |
|---|---|
| Steel | 40.0 |
| Air | 0.05 |
| Openwork Layer | 1.0 |

The approach of using a mid-piece with openwork constituted of a pattern of holes in a three-piece construct is illustrated in FIG. 8. One method of joining the three pieces 312*e*, 312*m*, 312*b* into a structure that ensures good thermal contact between layers is high temperature brazing. Brazing is a well-understood industrial process; see, for example, "The Brazing Guide", ©July 2009, Induction Atmospheres LLC. In the case of the construction illustrate in FIG. 8, brazing material would be applied to the contact area of each of the three pieces. Then the three-element piston crown would be joined under pressure in an alignment jig to ensure mechanical contact between pieces and brazing would be initiated by inductive heating. The result of this operation would be a piston having a crown with embedded air cavities of precisely controlled size and density to manage the overall piston temperature as well as local variations of heat input/output as would occur in the highly contoured structure shown in FIGS. 4, 5, 7, and 8. On the hot-side (that is to say, the end surface 332), these local variations in heat flux are due to the interaction between the charge air motion and features of the piston contour (ridge, bowl, etc.) as well as the proximity of the flame front. On the cold-side, the heat flux is concentrated at the cooling galleries. By managing the effective conductivity of the insulating structure 370 as function of location, and given suitable materials, the constructions described in this disclosure should enable a piston design that satisfies the three temperature constraints set forth in this disclosure.

Other options for manufacturing the construction illustrated in FIG. 8 include forging the end and mid pieces 312*e* and 312*m* in coining operations and forging the end piece into a mushroom shape which allows attachment to the crown by a seam welding operation.

The piston parts and the associated cylinder can be manufactured by casting and/or machining metal materials that include, without limitation, steel and/or aluminum.

Although the novel constructions and methods have been described with reference to a number of embodiments, it should be understood that various modifications can be made to them without departing from the spirit of the underlying principles. Accordingly, the patent protection to which the applicants are entitled is limited only by the following claims.

We claim:

1. An opposed-piston engine including at least one cylinder with longitudinally-separated exhaust and intake ports and a pair of pistons disposed in opposition to one another in a bore of the cylinder, each piston including a crown with an end surface, in which each end surface has a contour including an elongated bowl adjoined by a curved protruding ridge that cooperates with the end surface of the other piston to define a combustion chamber, and in which each piston includes an annular cooling gallery in the crown and an openwork with a pattern of holes defining cavities is embedded in the crown, between the end surface and the cooling gallery, the crown of each piston including an end piece on which the end surface is formed, a body piece with the annular cooling gallery, and a mid piece disposed between the end and body pieces in which the openwork is formed, and the openwork pattern of air cavities in each piston following the contour of the piston's end surface.

2. The opposed-piston engine of claim 1, in which each piston further includes a central cooling gallery girded by the annular gallery.

3. The opposed-piston engine of claim 1, in which an aggregate of space in the openwork is determined by at least one of size and density of the holes.

4. The opposed-piston engine of claim 3, in which the cavities are air cavities.

5. The opposed-piston engine of claim 1, in which the pattern includes an annular array of holes in the vicinity of a periphery of the crown.

6. A piston for an opposed-piston engine, comprising:

a crown with an end surface;

the end surface having a contour including an elongated bowl adjoined by a curved protruding ridge that cooperates with an end surface of another piston disposed in opposition to form a combustion chamber;

an annular cooling gallery in the crown; and a plurality of cavities embedded in the crown, between the end surface and the cooling gallery, in which the cavities are defined by an openwork with a pattern of holes that follows the contour; and, in which the crown includes an end piece on which the end surface is formed, a body piece with the annular cooling gallery, and a mid piece disposed between the end and body pieces in which the openwork is formed.

7. The piston of claim 6, in which an aggregate of space in the openwork is determined by at least one of size and density of the holes.

8. The piston of claim 7, in which the cavities are air cavities.

9. The piston of claim 6, in which the openwork pattern includes an annular array of holes in the vicinity of a periphery of the crown.

* * * * *